US007131941B2

(12) United States Patent
Makar et al.

(10) Patent No.: US 7,131,941 B2
(45) Date of Patent: Nov. 7, 2006

(54) THICKNESS ADJUSTMENT AND STABILIZER BAR SYSTEM FOR A CASE ERECTOR

(75) Inventors: Christopher Peter Makar, Vancouver (CA); Peter Clive Sewell, Vancouver (CA); Brett Warren Payne, Chilliwack (CA)

(73) Assignee: Wexxar Packaging Inc., British Columbia (CA)

( * ) Notice: Subject to any disclaimer, the term of this patent is extended or adjusted under 35 U.S.C. 154(b) by 179 days.

(21) Appl. No.: 10/981,456

(22) Filed: Nov. 5, 2004

(65) Prior Publication Data

US 2006/0100081 A1 May 11, 2006

(51) Int. Cl.
*B31B 1/78* (2006.01)
*B65B 43/30* (2006.01)

(52) U.S. Cl. ..... 493/309; 53/564

(58) Field of Classification Search ..... 493/309, 493/316; 53/458, 564, 381.1; *B31B 1/78; B65B 43/26, B65B 43/28, 43/30*
See application file for complete search history.

(56) References Cited

U.S. PATENT DOCUMENTS 4,018,143 A * 4/1977 Dice, Jr. et al. ..... 493/131
4,553,954 A 11/1985 Sewell et al.
4,621,485 A * 11/1986 Argazzi ..... 53/564
4,745,732 A * 5/1988 Tisma ..... 53/564
4,998,910 A * 3/1991 Mohaupt et al. ..... 493/12
6,080,095 A * 6/2000 Chen ..... 493/309
6,319,183 B1 * 11/2001 Ballos, III ..... 493/37
6,913,568 B1 * 7/2005 Frank et al. ..... 493/309
2004/0138039 A1 * 7/2004 Mazurek ..... 493/309

FOREIGN PATENT DOCUMENTS

DE 3440941 A1 * 5/1986
EP 1020361 A2 * 7/2000
JP 02296626 A * 12/1990

* cited by examiner

*Primary Examiner*—Stephen F. Gerrity
(74) *Attorney, Agent, or Firm*—Thompson Hine LLP

(57) ABSTRACT

A case forming machine for erecting cases from knock down case form to an open form and move an opened case downward to a bottom forming station using a fixed and a moveable jaw system is improved by providing a plurality of radially spaced, concentric stabilizer bars fixed to the fixed jaw and arranged to form concentric segments of circles centered on the pivotal axis of the moveable jaw and having their bottom edges in a radial plane relative to the pivotal axis. Also provided is a micrometer type adjustment mechanism that is used for adjusting the gap between the fixed and moveable jaws when the jaws are in the parallel pick-up position.

12 Claims, 3 Drawing Sheets

THICKNESS ADJUSTMENT AND STABILIZER BAR SYSTEM FOR A CASE ERECTOR

FIELD OF INVENTION

The present invention relates to a carton or case erector for squaring and erecting a case. More particularly the present invention relates to an improved case stabilizer system capable of stabilizing different sized cases as they are being erected. The present invention also relates to an improved case thickness adjusting system for the erector

BACKGROUND OF THE PRESENT INVENTION

In the manufacture (erection and taping of flaps to produce a carton or case from a knocked down blank) the knocked down carton or case is first squared and then the bottom flaps folded into closed position. The squaring operation generally withdraws a single knocked down case blank from a magazine of such blanks held in face to face position, opens the blank from the knocked down condition into a squared condition wherein adjacent side walls of the case are generally mutually perpendicular and positions the squared blank into a bottom flap folding station. In the bottom flap folding station the minor flaps (generally the shorter flaps) one connected to each of the leading and trailing side panels of the case (oriented in the direction of travel of the case from the erecting station) are folded relative to their respective side panels and then the major flaps one connected to each of the remaining side wall (walls parallel to the direction of travel) are folded into underlining relation (outwardly exposed relation) to the minor flaps. The so erected case is then moved into a bottom closure station which may be a taping station where a tape or adhesive is applied along the bottom major flaps extending in the direction of travel of the case through the taping station to secure the major flaps in folded closed position and thereby the case in squared condition with the adjacent side panels mutually perpendicular. In this condition the top closing flaps are generally in open position so that the case may be filled and then the top flaps are closed and secured in closed position for example by taping or adhesive similar to the bottom taping operation to complete the erecting filling and closing cycle and the filed box is ready for shipment.

U.S. Pat. No. 4,553,954 issued Nov. 10 1985 to Sewell et al. describes the erector to which the present invention is a significant improvement and the disclosure of this patent is incorporated herein by reference. This patent teaches the use of relatively pivoting jaws a fixed jaw oriented perpendicular to the direction of travel of a case through the erector i.e. from a bottom erector station and a moveable jaw that pivots on a pivotal axis between a pick-up or gripping position with the moveable jaw substantially parallel to and spaced from the fixed jaw to a position perpendicular to the fixed jaw. These erectors normally are designed to erect case blanks having significantly different thicknesses so the erector is normally made so that the spacing between the moveable and fixed jaws in the parallel position is adjustable to accommodate knocked down case blanks of different thicknesses. This is accomplished in the prior art by moving the fixed jaw.

The jaws grip the top flaps extending from a pair of adjacent side panels of a case and open (square) the case by pivoting the moveable jaw on the pivotal axis. These jaws in their mutually perpendicular position (open or squaring position) then move the so opened (squared) case down into the bottom erecting station wherein bottom flaps are folded as above described.

In the prior art system a single substantially circular stabilizer bar is removably mounted on the fixed jaw and extends in an arc centered on the pivot axis or hinge point between the jaws and passes through suitable opening in the moveable jaw (to permit the relative movement of the moveable jaw between parallel (pick-up) and open (squaring) position). The stabilizer bar is positioned with its bottom edge in position to contact with to top edges of the other major and minor top flaps adjacent to the free corner (corner remote from the pivotal axis) of the case to keep the case in proper orientation i.e. stop the free corner of the case from moving upward as the case is moved into the bottom forming station. The stabilizer bar must be moveably mounted to accommodate different sized cases i.e. cases having their free corner spaced from the pivotal axis by significantly different lengths and the above described thickness adjustment (change in the space between the fixed and moveable jaws in the parallel pick-up or gripping position) to position the stabilizer bar in a position whereby it will pass through holes in the moveable jaw positioned between adjacent grippers.

In the prior art machine wherein the stabilizer bar position required adjustment when significantly different sized boxes or cases were to be erected the spacing between the jaws in the parallel pick up position which also had to be changed when knocked down blanks for cases of significantly different thickness were to be erected, was adjusted by physically moving the fixed jaw. Movement of the fixed jaw requires unbolting the fixed jaw, moving it and bolting it back in position which also required in many cases that the separator bar that moves the lead blank down from the magazine (see U.S. Pat. No. 4,553,954) required adjustment to be properly positioned relative to the fixed jaw in its new position. These procedures required a significant amount of time and skill to ready the machine to process blanks of the new (different) thickness.

BRIEF DESCRIPTION OF THE PRESENT INVENTION

It is the main object of the present invention to provide an improved stabilizer system requiring no adjustment to accommodate different sized cases.

It is a further object of the present invention to provide a simplified and easier operated adjustment system for accommodating knocked down cases of different thicknesses.

Broadly the present invention relates to a case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular, a plurality of radially spaced, concentric stabilizer bars fixed adjacent to one end to said fixed jaw and arranged to form concentric segments of circles centered on said pivotal axis, passages through said moveable jaw positioned to permit said bars to pass through said moveable jaw as said moveable jaw is moved between said pick-up and open positions, said bars having their bottom edges in a radial plane relative to said pivotal axis.

Preferably an interconnecting bar interconnects said bars on the side of said moveable jaw remote from said fixed jaw.

Preferably said bars have essentially the same cross sectional shape and a width measured in a direction radial to said pivotal axis significantly less than the height of said bars measured parallel to said pivotal axis.

Preferably said moveable jaw is mounted on an adjustment mechanism that adjusts the position of said moveable jaw so that the gap between said moveable and said adjustable jaw in said parallel pick-up position is changed.

Broadly the present invention also relates to a case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular, the improvement comprising an adjustment mechanism having a mounting portion and an adjustment portion, said mounting portion mounted for pivotal movement on said pivotal axis and said adjustment portion being moveable relative to said mounting portion in a direction substantially parallel to said fixed jaw when said moveable jaw is in said open squaring position and means to move said adjusting portion relative to said mounting portion thereby adjusting the gap between said fixed and moveable jaws when said jaws are in said parallel pick-up position.

Preferably said means to move comprises a manually operable micrometer type adjustment system.

Preferably a stop damper mounted in a fixed position relative to the fixed jaw dampens movement of said moveable jaw as it approaches said open perpendicular position and stops said moveable jaw in said open perpendicular position.

Preferably a second stop damper mounted in a fixed position relative to the fixed jaw dampens movement of said moveable jaw as it approaches said parallel pick-up position and stops said moveable jaw in said parallel pick-up position.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
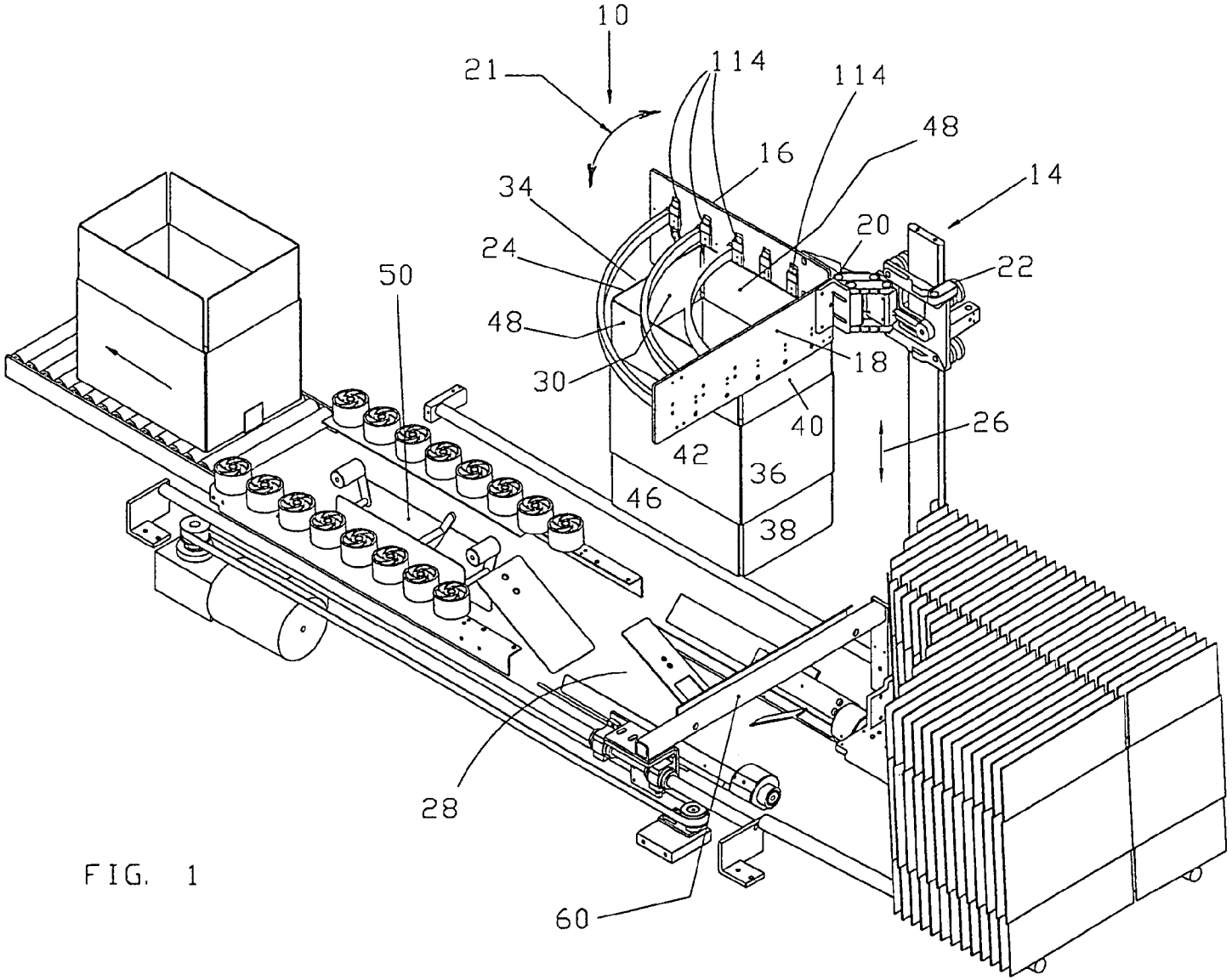
FIG. 1 is a schematic isometric illustration of the operation of a typical erector with the present invention in place and illustrating the operation of the erector.

FIG. 1 illustrates a typical application of the present invention and particularly showing the invention applied to an erector of type described in U.S. Pat. No. 4,553,954 referred to above and incorporated herein by reference.

Figure 4:
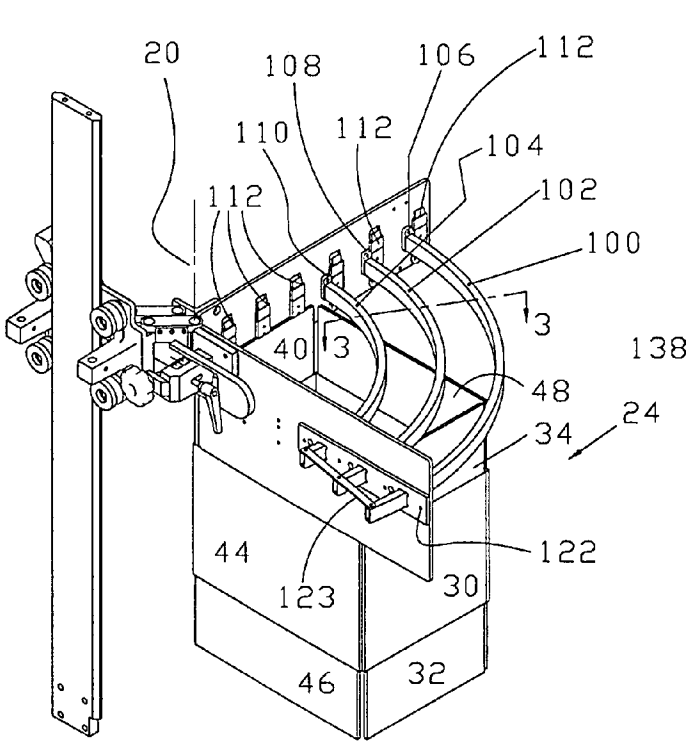
FIG. 4 is an isometric view with parts omitted for clarity similar to FIG. 2 but with the jaws in open squaring position i.e. with the jaws perpendicular to each other.

The erector and sealer 10 is provided with a magazine 12 containing knocked down box blanks which are extracted and squared by the mechanism 14 which include a moveable jaw 16 and a fixed jaw 18. The moveable jaw 16 is pivoted by a suitable drive as represented and indicated by arrow 21 on pivotal axis or hinge 20 between a pick-up or gripping position wherein the jaws 16 and 18 are in opposed substantially parallel position (see FIGS. 2, 5 and 6) and a squaring or open position wherein the jaws are substantially mutually perpendicular as shown in FIGS. 1 and 4. The fixed and moveable jaws 18 and 16 carrying an open or squared case 24 (squared by movement of the jaw 16 to the perpendicular or squaring position) are then moved vertically by the elevator mechanism schematically indicated at 22 as indicated by the arrow 26. The jaws in pick-up position (substantially parallel) receive a knocked down blank there between and engage and move same from the magazine as described in U.S. Pat. No. 4,553,954 and as indicated below. The jaws 16 and 18 are then opened to the position illustrated i.e. at a right angle to each other, to square the case 24 which is then moved downward as indicated by the arrow 26 into the bottom flap folding station 28 (see U.S. Pat. No. 4,553,954 and related improvements forming the subject matter of other about to be applied for patents).

Figure 2:
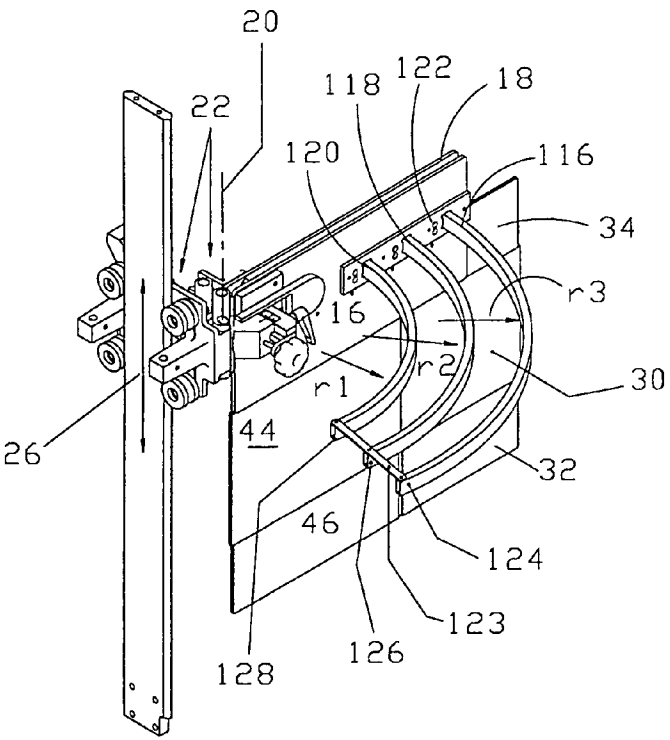
FIG. 2 is an isometric view with parts omitted for clarity of the opening jaws in parallel pick-up position with the stabilizer bars of this invention in position.

The squared case 24 has a leading wall panel 30 (leading in the direction of movement of the case through the machine 10 from the bottom flap folding station 28 to and through the bottom sealing station 50 which in the illustrated arrangement is a tape applying station (as indicated by the arrow 52)) to which are connected a leading bottom flap 32 and a leading top flap 34 (see FIGS. 2 and 4). The case 24 has a corresponding trailing wall 36 with corresponding trailing bottom 38 and top 40 trailing flaps. The leading and trailing wall panels 30 and 36 are interconnected by a pair of opposed side wall panels 42 and 44 each with their bottom and top flaps 46 and 48 (the bottom flap 46 connected to side wall 44 is visible in FIG. 3). The shorter leading and trailing sides and flaps are generally referred to as minor side walls or flaps and the longer walls 42 and 44 and their respective bottom and top flaps 46 and 48 are generally called the major side walls or flaps. Generally but not necessarily the major walls and flaps are oriented parallel to the direction of travel 52 which as will be apparent is the direction of tape application in the illustrated bottom taper 50 so the major flaps are folded last and are exposed as the case 24 is moved into the bottom sealing station 50 which is shown as a taping station 50 and the tape is applied to these flaps 46.

The folding station 28 is provided with conventional flap folding equipment for folding the leading flap and trailing flaps 32 and 38 to fold these flaps 32 and 38 to positions substantially perpendicular to their respective leading and trailing wall panels 30 and 36 as the case 24 is moved down in the direction of the arrows 26. Next the major bottom flaps 46 are folded substantially perpendicular to their respective side wall panels 42 and 44.

The squared case 24 with its bottom flaps 32, 38 and 46 folded is then advanced into and through the bottom sealing station 50 by any suitable mechanism 60 (in the illustrated version a pusher mechanism (subject of U.S. application Ser. No. 10/981,455 filed concurrently herewith by Makar et al (WEX5) has been shown).

As above described in the prior art machines the most relevant of which (to Applicant's knowledge) is described in U.S. Pat. No. 4,553,954 a single movably mounted stabilizer bar was employed and was moved to the appropriate location when different sized cases were to be erected. This operation required tools and took the operator a significant amount of time to accomplish.

The present invention overcomes many of the shortcomings of the old system by fixing one end of each of a plurality (3 in the illustrated embodiment shown in FIGS. 1 to 5) of stabilizer bars 100, 102 and 104 (see particularly FIGS. 2 and 3 and 4) mounted in fixed relation to the fixed jaw 18 as indicated at 106, 108 and 110 respectively (see FIG. 4). These bars 100, 102 and 104 form quadrants of concentric circles as indicated by the radius $r_1$, $r_2$ and $r_3$ respectively (see FIG. 2) centered on the hinge or pivotal axis 20 about which the moveable jaw 16 is pivoted when moving between the substantially parallel pick up position (See FIG. 5) and the open or squaring position (see FIGS. 1, 2 or 4) wherein the jaws 16 and 18 are mutually perpendicular.

In the illustrated arrangement gripping pins or pin holders 112 such as those taught in U.S. Pat. No. 4,553,954 but preferably of the type forming the subject matter of application Ser. No. 10/981,455, filed concurrently herewith by Makar et al (WEX4) are positioned adjacent to and between the mountings 106, 108 and 110 of the bars 100, 102 and 104 to the jaw 18. Similar gripping pins or pin holders 114 (see FIG. 1) are provided on the jaw 16 but are positioned on the opposite side of their respective adjacent bar 100, 102 or 104 as the pins 112. The pins or pin holders 112 and 114 are positioned in staggered relationship so that when the jaws 16 and 18 are in the parallel pick-up or gripping position (see FIGS. 2, 5 and 6) the pins or pin holders 112 and 114 do not clash and interfere with the closing of the jaw 16 into the parallel pick-up position relative to the jaw 18.

The bars 100, 102 and 104 pass through suitably positioned holes 116, 118 and 120 respectively through the jaw 16 (see FIG. 2). In the illustrated arrangement a suitable bearing panel 122 with apertures corresponding to the holes 116, 118 and 120 through which the bars 100, 102 and 104 pass is provided. The bearing panel 122 is made from material that will facilitate relative movement should the bars 100, 102 and/or 104 come in contact with the sides of the apertures.

In the preferred form of the invention a suitable reinforcing bar 123 interconnects the free ends 124, 126 and 128 of the bars 100, 102 and 104 respectively at the side of the jaw 16 remote from the jaw 18 to maintain the correct spacing between these free ends.

Figure 3:
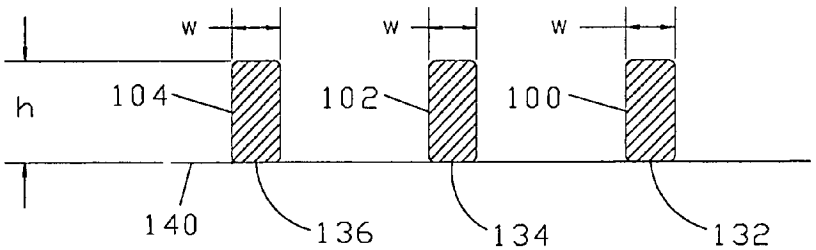
FIG. 3 is a section along the line 3—3 of FIG. 4

As illustrated in FIG. 3 the bars 100, 102 and 104 have essentially the same cross sectional shape and a width w measured in a direction radial to the pivotal axis 20 significantly less than the height h of said bars measured parallel to said pivotal axis 20.

As is apparent in FIGS. 3 and 4 the bottom edges 132, 134 and 136 of the bars 100, 102 and 104 are in a common radial plane 140 relative to the axis 20 and are positioned to engage the top edges of flaps 34 and 48 adjacent to the free corner 138 of the case 24 (corner remote from the hinge axis 20) so that this corner 138 is positioned at the same level as the opposite corner of the case 24 when the case 24 is forced down into the bottom flap folding station 28 i.e. contact of the bottom flaps with elements of the station 28 cannot move the top edges of the flaps 34 and 48 forming the free corner 138 upward past the plane 140 defined by the bottom edges 132, 134 and 136 which would distort the box or case 24.

In the FIG. 4 illustration the case 24 is relatively large and its free corner engages the largest radius bar 100, it will be apparent that when smaller cases are being erected the smaller radius bar 102 or 104 will engage the free corner 138 of the small case and function in the same manner. Thus a plurality or range of box or case sizes may be erected without requiring modification of the equipment thereby significantly decreasing down time when the size of the case being erected is significantly changed.

Figure 5:
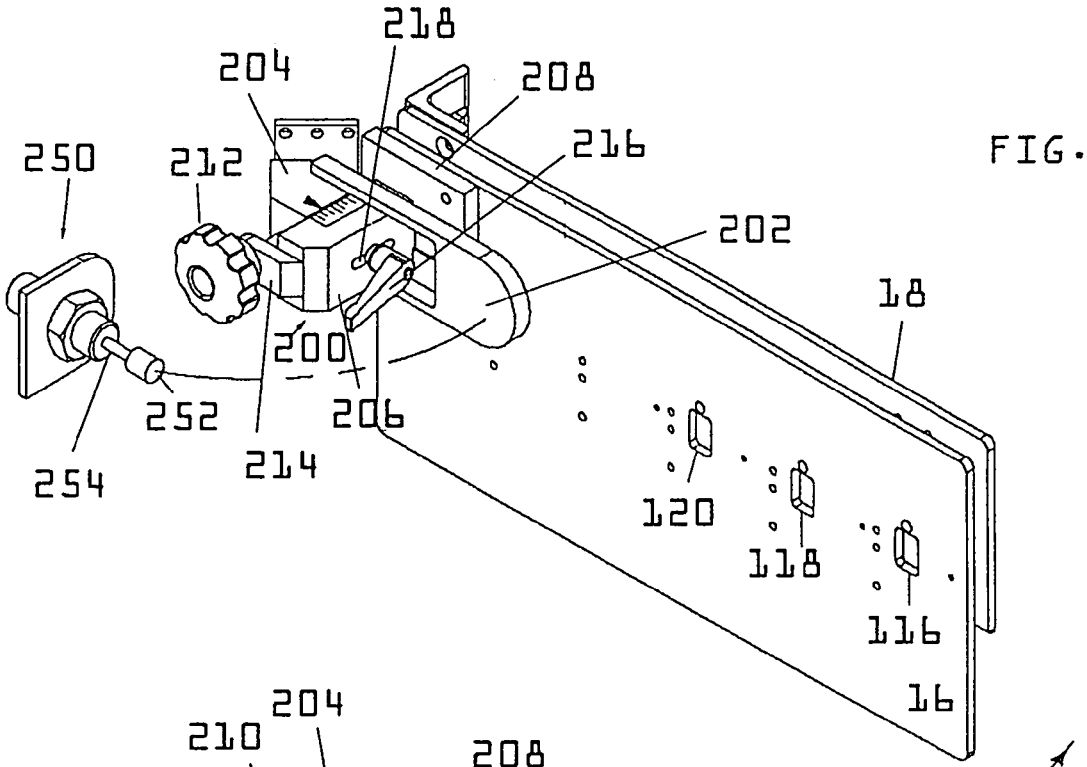
FIG. 5 is a view with parts removed for clarity showing the jaws in their substantially parallel pick-up position and parts of the micrometer gap adjustment mechanism for adjusting the gap between the jaws in the parallel pick-up position to accommodate knocked down case blanks of different thickness.
Figure 6:
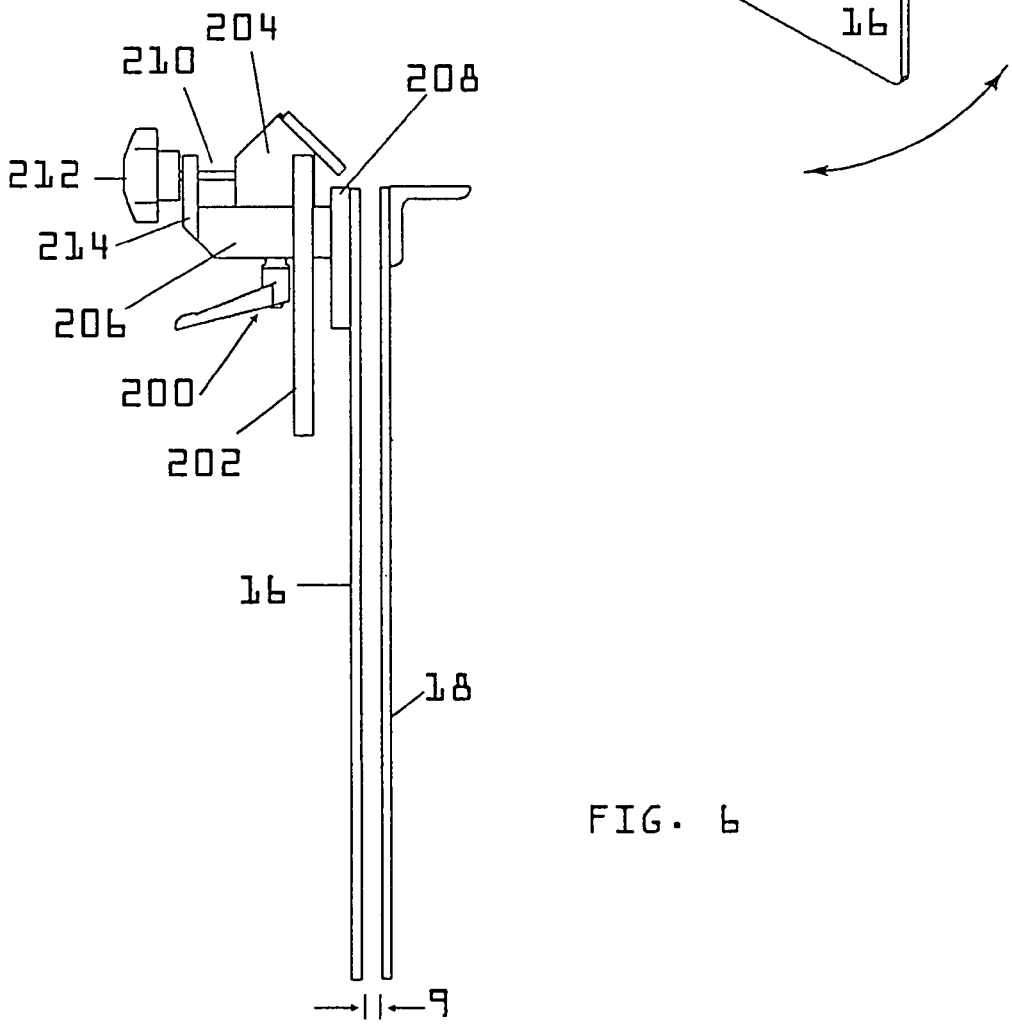
FIG. 6 is a plan view of the jaws in the pick-up position.

FIGS. 5 and 6 show the micrometer adjustment system generally indicated at 200 for changing the gap dimension g (see FIG. 6) defining the gap between the two jaws 16 and 18 when in parallel pick-up position. This gap dimension g is adjusted by manipulating the gap adjustment micrometer type adjustment system 200.

The system 200 includes a mounting and bumper plate 202 that is connected to and extends from the hinge having a pivotal axis 20 described above via a mounting block 204. A mounting and adjustment bar 206 is mounted to slide through and be guided by a passage through the plate 202 and is connected to the moveable jaw 16 via the mounting plate 208 which supports the jaw 16 in cantilever fashion. The micrometer adjustment mechanism includes a treaded shaft 210 operated by threads in a corresponding threaded aperture in the block 204 so that turning the knob 212 moves the threaded shaft 210 relative to the block in micrometer type increments. The threaded shaft 210 is connected to an operating arm 214 extending from the block 206 so that movement of the arm 214 imparts like movement to the block 206. The connection between the arm 214 and the treaded shaft 210 permits substantially free rotation of the shaft 210 while preventing relative axial movement between the shaft 210 and the arm 214 so that axial movement of the shaft 210 is applied to the arm 214 and thereby through the bar 206 and mounting plate 208 to the jaw 16. Preferably a locking bolt extends from the block 204 through a suitable slot 218 in the bar 206 and is represented by its nut which is in the form of a hand lever 216. Turning the hand lever nut 216 in one direction releases the bar for axial movement (gap adjustment) and adjustment of the gap g and turning of the lever 216 in the opposite direction forces the bar 206 against the block 204 and locks the bar 206 and thereby the jaw 16 in adjusted position.

Preferably a suitable damper and stop device 250 having a bumper 252 is mounted in fixed relationship to the fixed jaw 18 and is positioned to be engaged by a portion of the plate 202 on the side of the bar 206 remote from the block 204. The bumper is mounted on a pneumatically biased shaft 254 which functions to dampen and aid in stopping the movement of the jaw 16 at the appropriate position. A similar damper may be provided to dampen and stop the movement of the jaw 16 as it moves into the parallel pick-up position. It will be apparent that the size of the passages 116, 118 and 120 will be sufficient to accommodate any displacement of the jaw 16 by the adjustment mechanism 200.

Having described the invention, modifications will be evident to those skilled in the art without departing from the scope of the invention as defined in the appended claims.

We claim:

1. A case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular, a plurality of radially spaced, concentric stabilizer bars fixed adjacent to one end to said fixed jaw and arranged to form concentric segments of circles centered on said pivotal axis, passages through said moveable jaw positioned to permit said bars to pass through said moveable jaw as said moveable jaw is moved between said pick-up and open positions, said bars having their bottom edges in a radial plane relative to said pivotal axis.

2. A case forming machine for erecting cases from knock down case form to an open form and move an opened case downward to a bottom forming station as defined in claim 1 wherein an interconnecting bar interconnects free ends of said stabilizers bars on the side of said moveable jaw remote from said fixed jaw.

3. A case forming machine for erecting cases from knock down case form to an open form and move an opened case downward to a bottom forming station as defined in claim 2 wherein said moveable jaw is mounted on an adjustment mechanism that adjusts the position of said moveable jaw so that a gap between said moveable and said adjustable jaw in said parallel pick-up position is changed.

4. A case forming machine for erecting cases from knock down case form to an open form and move an opened case downward to a bottom forming station as defined in claim 2 wherein said bars have essentially the same cross sectional shape and a width measured in a direction radial to said pivotal axis significantly less than the height of said bars measured parallel to said pivotal axis.

5. A case forming machine for erecting cases from knock down case form to an open form and move an opened case downward to a bottom forming station as defined in claim 4 wherein said moveable jaw is mounted on an adjustment mechanism that adjusts the position of said moveable jaw so that a gap between said moveable and said adjustable jaw in said parallel pick-up position is changed.

6. A case forming machine for erecting cases from knock down case form to an open form and move an opened case downward to a bottom forming station as defined in claim 1 wherein said bars have essentially the same cross sectional shape and a width measured in a direction radial to said pivotal axis significantly less than the height of said bars measured parallel to said pivotal axis.

7. A case forming machine for erecting cases from knock down case form to an open form and move an opened case downward to a bottom forming station as defined in claim 6 wherein said moveable jaw is mounted on an adjustment mechanism that adjusts the position of said moveable jaw so that a gap between said moveable and said adjustable jaw in said parallel pick-up position is changed.

8. A case forming machine for erecting cases from knock down case form to an open form and move an opened case downward to a bottom forming station as defined in claim 1 wherein said moveable jaw is mounted on an adjustment mechanism that adjusts the position of said moveable jaw so that a gap between said moveable and said adjustable jaw in said parallel pick-up position is changed.

9. A case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular, the improvement comprising an adjustment mechanism having a mounting portion and an adjustment portion, said mounting portion mounted for pivotal movement on said pivotal axis and said adjustment portion being moveable relative to said mounting portion in a direction substantially parallel to said fixed jaw when said moveable jaw is in said open squaring position and means to move said adjusting portion relative to said mounting portion thereby adjusting the gap between said fixed and moveable jaws when said jaws are in said parallel pick-up position.

10. A case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular as defined in claim 9 wherein said means to move comprises a manually operable micrometer type adjustment system.

11. A case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular as defined in claim 10 wherein a stop damper mounted in a fixed position relative to fixed jaw dampens movement of said moveable jaw as it approaches said open perpendicular position and stops said moveable jaw in said open perpendicular position.

12. A case forming machine for erecting cases from knock down case form to an open form and move an opened case downward to a bottom forming station comprising a fixed jaw and a moveable jaw mounted for movement on a pivotal axis between a pick-up position wherein said fixed and moveable jaws are substantially parallel and an open squaring position wherein said fixed and moveable jaws are substantially perpendicular as defined in claim 9 wherein a stop damper mounted in a fixed position relative to fixed jaw dampens movement of said moveable jaw as it approaches said open perpendicular position and stops said moveable jaw in said open perpendicular position.

* * * * *